United States Patent [19]

Grady

[11] Patent Number: 4,510,631

[45] Date of Patent: Apr. 16, 1985

[54] COMMODE

[76] Inventor: Marilyn Grady, 7541 S. Crane Dr., Oak Creek, Wis. 53154

[21] Appl. No.: 552,697

[22] Filed: Nov. 17, 1983

[51] Int. Cl.[3] ..... A47K 11/04

[52] U.S. Cl. ..... 4/478; 4/254; 4/480; 280/43.24; 297/DIG. 4

[58] Field of Search ..... 4/483, 478, 479, 480, 4/254; 297/DIG. 4; 280/43.24

[56] References Cited

U.S. PATENT DOCUMENTS

| | | | |
|---|---|---|---|
| 894,949 | 8/1908 | Hendricks | 280/43.24 X |
| 1,419,947 | 6/1922 | Schouten | 4/479 X |
| 2,176,551 | 10/1939 | Solem | 297/DIG. 4 |
| 2,377,649 | 6/1945 | Quinney | 280/43.24 X |
| 2,530,474 | 11/1950 | Lutes | 4/483 |
| 2,596,055 | 5/1952 | Thomas | 297/DIG. 4 |
| 2,830,304 | 4/1958 | Ericsson | 280/43.24 X |
| 3,350,095 | 10/1967 | Claseng | 280/43.24 |
| 3,727,903 | 4/1973 | Brown | 280/43.24 X |
| 4,028,749 | 6/1977 | James | 4/480 |
| 4,334,330 | 6/1982 | Marshall | 4/480 |
| 4,428,615 | 1/1984 | Hynson | 4/483 |

*Primary Examiner*—Henry K. Artis

*Attorney, Agent, or Firm*—Andrus, Sceales, Starke & Sawall

[57] ABSTRACT

A portable commode includes a pair of stabilizing legs which engage the floor when the commode is in use and further includes a connecting device to secure the commode to a bed or other structure in order to provide stability as the user moves from the bed to the commode. A restraining bar spans the seat area to maintain the user in position.

6 Claims, 4 Drawing Figures

FIG. 3
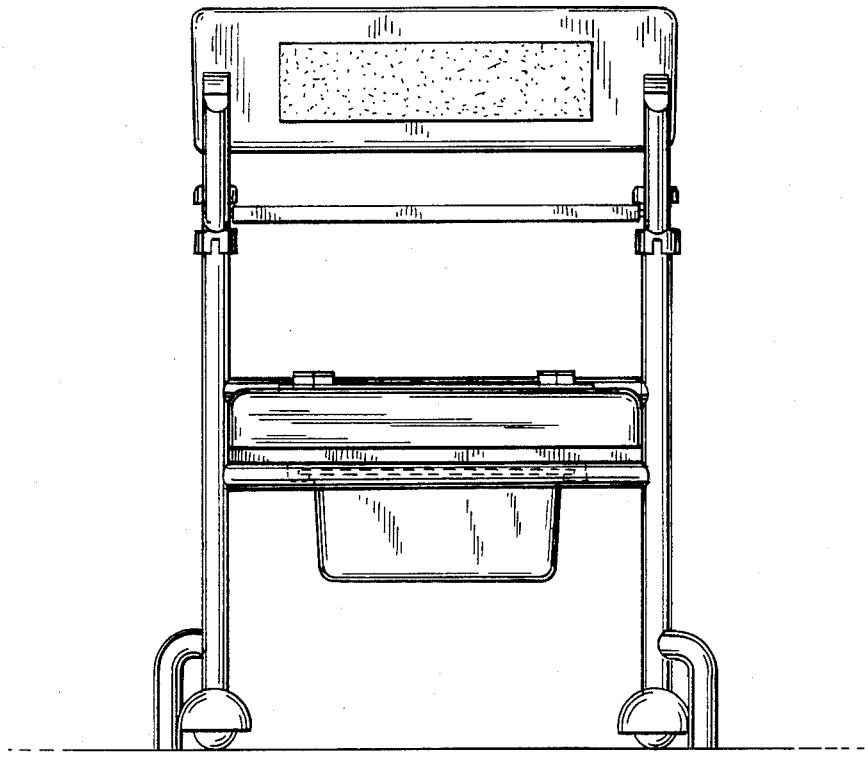
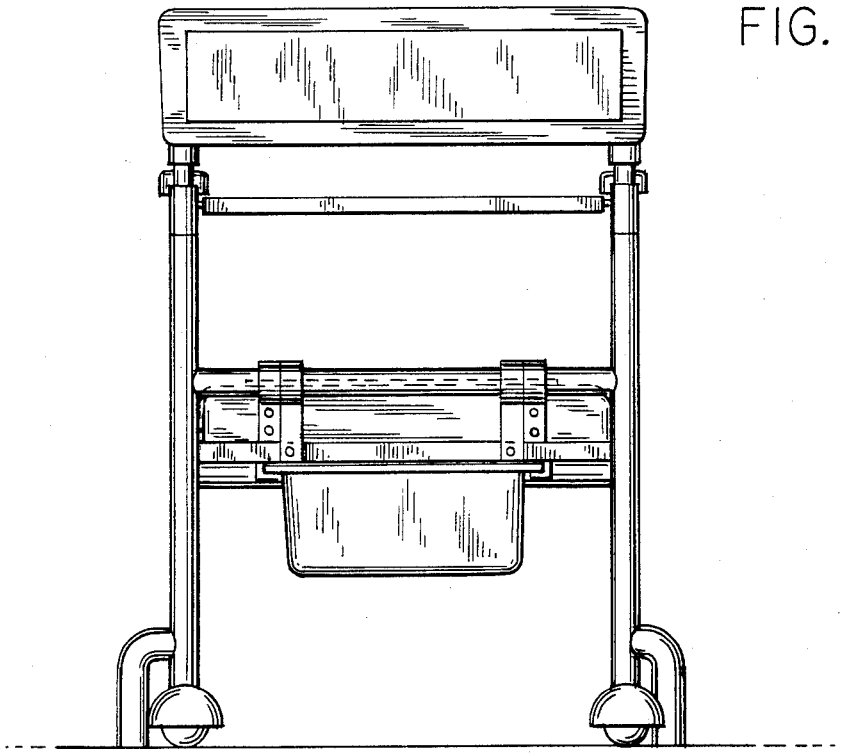
FIG. 4

COMMODE

PRIOR ART OF INTEREST

The following patents have been located by the Applicant:

| U.S. Pat. No. | Inventor | Issue Date |
|---|---|---|
| 321,915 | Rubenstein | 07-07-1885 |
| 1,496,843 | Delarm | 06-10-1924 |
| 2,745,112 | Binbelu | 05-15-1956 |
| 3,795,923 | Thomas | 03-12-1974 |
| 3,829,908 | Thomas | 08-20-1974 |

BACKGROUND OF THE INVENTION

The present invention relates to commodes and more particularly to portable commodes for use by semiinvalid or bedridden people.

Prior art commodes of this type have lacked either stability or portability.

The commodes such as those shown in the patents listed above must be lifted when moved into position, while more modern commodes of the wheeled type lack the necessary stability for supporting the weight of the patient as he or she moves from the bed to the commode.

Prior art commodes also lack devices for maintaining the patient in position on the commode in situations where the patient may have trouble maintaining his or her balance.

Therefore, it is an object of the present invention to provide a portable commode which may be easily moved into position at bedside and once in position may be secured to the bedside and provide a stable structure which may be utilized by the patient for support or balance purposes as the patient moves from the bed to the commode.

It is a further object of the invention to provide a commode having an adjustable restraint for maintaining the user in position while seated on the device.

SUMMARY OF THE INVENTION

A portable commode includes a pair of stabilizing legs mounted adjacent diagonally opposite wheels. The stabilizing legs do not engage the surface on which the wheels rest until the user of the commode is positioned on the device. The stabilizing legs then engage the surface and stabilize the commode. As the patient moves from the bed to the commode the weight of the patient on the commode will engage the stabilizing legs and help prevent tipping of the commode.

In accordance with yet another aspect of the invention, the commode is provided with a pair of connector arms that secure the commode to the bedside to prevent relative movement between the commode and the bed.

In accordance with yet another aspect of the invention the commode is provided with a restraint bar that is releasably and adjustably attached to the armrest of the commode and spans the area between the armrest. The restraint secures the user in an upright position while the commode is in use.

The present invention thus provides a commode that may be easily moved to the bedside and once in position at the bedside may be secured to the bed and thus provide an added degree of stability to the device and a greater feeling of security to the user as he or she moves from the bed to the commode.

BRIEF DESCRIPTION OF THE DRAWINGS

The drawings illustrate the best mode presently contemplated of carrying out the invention.

In the drawings:

FIG. 3 is a front elevational of the commode of FIG. 1; and

FIG. 4 is a rear elevational view of the commode of FIG. 1.

DESCRIPTION OF THE PREFERRED EMBODIMENT

Figure 1:
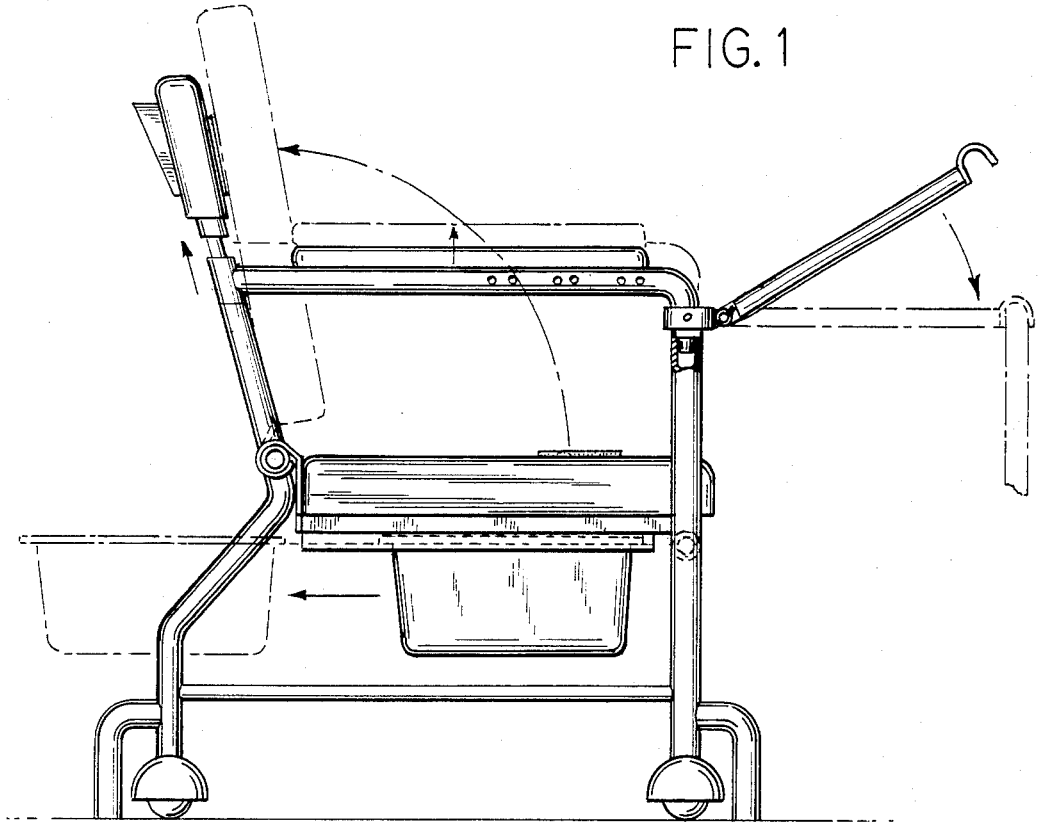
FIG. 1 is a side elevational view of a portable commode constructed according to the invention.
Figure 2:
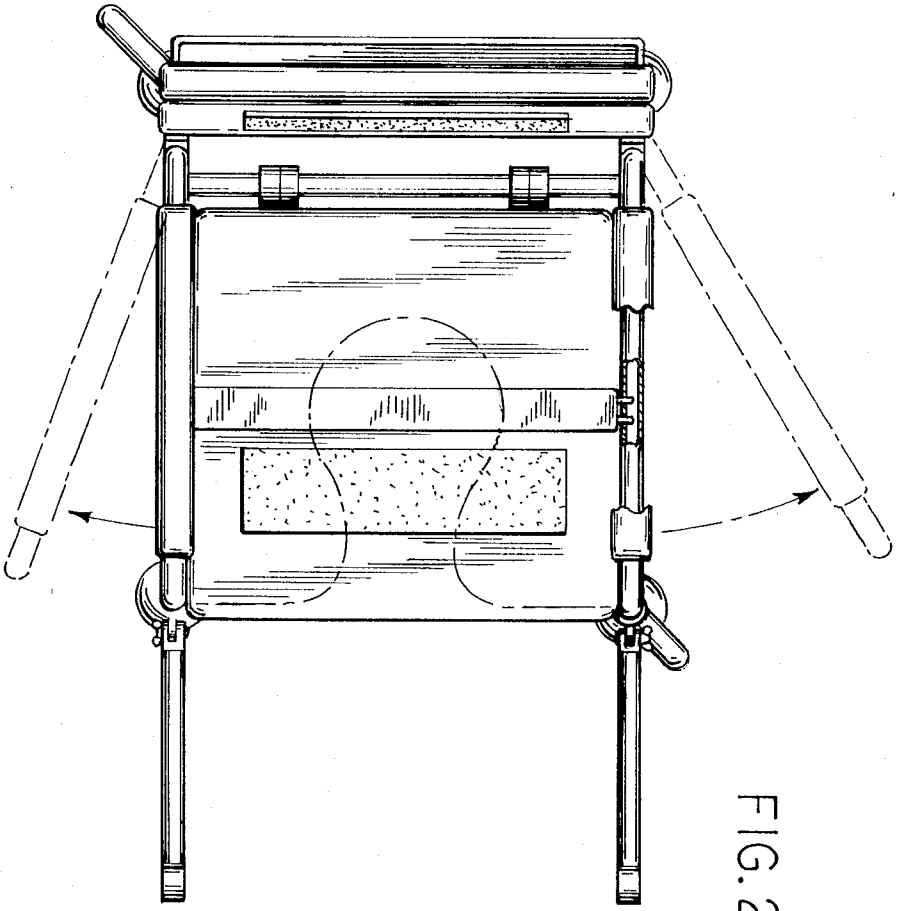
FIG. 2 is a top plan view of the commode of FIG. 1.

As seen in FIG. 1 a portble commode 10 includes a support structure 12 mounted on wheels 14.

A padded seat 16 is pivotally connected to support structure 12 at pivot point 18. In its lower position padded seat 16 covers conventional toilet seat 20 and allows commode 10 to be utilized a a conventional chair. In its raised position padded seat 16 serves as a backrest for the user of commode 10. A velcro strip 22 provided along headrest 24 engages velcro strip 25 on padded seat 16 in order to releaseably maintain seat 16 in its raised position.

Support structure 12 is provided with a pair of armrests 26 which are pivotally connected to support structure 12 at pivot point 28. The pivotal connection allows armrest 26 to be rotated in a horizontal plane and thus allows entry into commode 10 from either side. Each of armrests 26 is provided with a series of holes 30 spaced along the length of armrest 26. Holes 30 are engaged by brackets 32 on each end of restraining bar 34. Restraining bar 34 spans the area between armrest 26 and is placed into position after the user of commode 10 has been seated. Restraining bar 34 maintains the user in position and may be placed along armrest 26 in a position to suit the user.

Receptacle 36 is slidably mounted in brackets 38 mounted on support structure 12 beneath toilet seat 20. This allows receptacle 36 to be slidably removed from the rear of commode 10 without disturbing the user.

A pocket 40 is provided on the back of headrest 24 and may be used for storing tissue or cleaning products.

Each of legs 42 on support structure 12 terminates at its lower end in spring mounted wheel 14 covered by dome 44. With no weight on commode 10 wheels 14 are in their extended position and allow commode 10 to be rolled into position. When weight is placed on commode 10 spring loaded wheels 14 retract into the bottom of legs 42 and domes 44 engage the floor.

The lower end of a pair of diagonally opposed legs are provided with supplemental support legs 46. Support legs 46 terminate slightly above floor 48 when wheels 14 are in their extended position. However, when weight is placed upon commode 10 so that wheels 14 retract, supplemental support legs 46 engage floor 48 and provide aditional stability to commode 10.

Commode 10 is provided with a pair of extension arms 50 having elastic clips 52 which releasably secure arms 50 to the front of support structure 12. Extension arms 50 are pivotally mounted to clips 52 at one end and have a hook like portion 54 at their other end. Hook portion 54 engages railing 56 or some other portion of the bed to prevent relative movement between commode 10 and the bed while the patient moves from the bed to the commode.

The present invention thus provides a portable commode which may be securely locked into place so that patient need not be concerned that the commode will move, shift or tip as the patient moves from the bed to the commode.

Various modes for carrying out the invention are contemplated as being within the scope of the following claims particularly pointing out and distinctly claiming the subject matter which is regarded as the invention.

I claim:

1. A bedside commode having a seat, a wheel mounted support structure for the seat and a pair of side armrests and a backrest on the support structure, said commode comprising, a connector arm extending outwardly from the front of said commode with one end of said arm having means for pivotally connecting said arm to said commode and the other end of said arm having means for releasably securing said commode to a bed and maintaining said commode a predetermined distance from said bed so that said commode is maintained in a position with the forward edge of said seat parallel to and a predetermined distance from the side of said bed so that the user of said commode may position his legs in the space between said bed and said commode.

2. The commode defined in claim 1 comprising a second connector arm pivotally connected to said commode and extending outwardly from the front of said commode, said connector arms being connected to opposite sides of the commode and cooperating with each other, the front edge of said commode and said bedside to define a substantially rectangular opening in which the user of said commode may place his legs while positioning himself on and using said commode.

3. The commode defined in claim 1 comprising, at least two stabilizing legs mounted to substantially opposite sides of the support structure and extending out from the support structure, said stabilizing legs not engaging the surface on which the wheels rest when said commode is unoccupied in order to allow said commode to be wheeled into and out of position and said stabilizing legs engaging said surface when said commode is occupied in order to further stabilize said commode.

4. The commode defined in claim 1 wherein the support structure is substantially rectangular and has wheels at its four corners and said stabilizing legs are mounted substantially adjacent diagonally opposed wheels.

5. The commode defined in claim 1 comprising, restraint means releasably attached to the armrests and spanning the area between the armrests to hold the user of said commode in position.

6. The commode defined in claim 5 wherein said restraint means engages the armrests at any one of a plurality of positions in order to allow the distance between said restraint means and the back rest to be varied.

* * * * *